US009054431B2

(12) United States Patent
Endo

(10) Patent No.: US 9,054,431 B2
(45) Date of Patent: Jun. 9, 2015

(54) PRESS BOND TERMINAL

(75) Inventor: Tatsuya Endo, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/504,292

(22) PCT Filed: Oct. 25, 2010

(86) PCT No.: PCT/JP2010/068881

§ 371 (c)(1),
(2), (4) Date: Apr. 26, 2012

(87) PCT Pub. No.: WO2011/052548

PCT Pub. Date: May 5, 2011

(65) Prior Publication Data

US 2012/0214361 A1 Aug. 23, 2012

(30) Foreign Application Priority Data

Oct. 28, 2009 (JP) ..... 2009-247863

(51) Int. Cl.

| | |
|---|---|
| ***H01R 4/10*** | (2006.01) |
| ***H01R 4/18*** | (2006.01) |
| ***H01R 4/20*** | (2006.01) |
| *H01R 43/16* | (2006.01) |
| *H01R 13/11* | (2006.01) |

(52) U.S. Cl.

CPC ..... *H01R 4/185* (2013.01); *H01R 4/203* (2013.01); *H01R 43/16* (2013.01); *H01R 4/188* (2013.01); *H01R 13/11* (2013.01)

(58) Field of Classification Search

USPC ..... 439/851, 877

See application file for complete search history.

(56) References Cited

U.S. PATENT DOCUMENTS

| | | | | |
|---|---|---|---|---|
| 3,831,132 | A | 8/1974 | Bowden, Jr. et al. | |
| 3,892,459 | A * | 7/1975 | Dittmann et al. | 439/442 |
| 4,010,538 | A * | 3/1977 | O'Keefe et al. | 29/865 |
| 5,549,483 | A | 8/1996 | Hotea | |
| 5,593,328 | A * | 1/1997 | Okada et al. | 439/851 |

(Continued)

FOREIGN PATENT DOCUMENTS

| | | | |
|---|---|---|---|
| CN | 1102513 | A | 5/1995 |
| JP | 55-120079 | A | 8/1980 |

(Continued)

OTHER PUBLICATIONS

International Search Report for PCT/JP2010/068881, dated Nov. 22, 2010 [PCT/ISA/210].

(Continued)

*Primary Examiner* — Tho D Ta

(74) *Attorney, Agent, or Firm* — Sughrue Mion, PLLC

(57) ABSTRACT

A press bond terminal in which the terminal is provided with an electrical connection part on which is provided a conductor press bond part connected by being pressed and bonded to a conductor of an electric wire through a first joining part and the conductor press bond part is further provided with a coating crimp part through a second joining part and the conductor press bond part is formed in substantially a U-shaped cross section by a base plate and a pair of conductor crimp pieces and both joining parts are formed in substantially U-shaped cross sections by base plates and a pair of low side plates, with projections provided on any inner surfaces of the conductor crimp pieces or inner surfaces of the side plates of the joining parts.

4 Claims, 3 Drawing Sheets

(56) References Cited

U.S. PATENT DOCUMENTS

| | | | | |
|---|---|---|---|---|
| 6,468,116 | B2 * | 10/2002 | Koide | 439/867 |
| 6,755,697 | B2 | 6/2004 | Kojima et al. | |
| 7,901,257 | B2 * | 3/2011 | Okamura et al. | 439/877 |
| 2006/0264124 | A1 * | 11/2006 | Meyer et al. | 439/877 |
| 2010/0029142 | A1 | 2/2010 | Hiramitsu et al. | |
| 2010/0105257 | A1 | 4/2010 | Kumakura et al. | |
| 2012/0006596 | A1 | 1/2012 | Kuwayama | |
| 2012/0208409 | A1 * | 8/2012 | Endo | 439/877 |

FOREIGN PATENT DOCUMENTS

| | | | |
|---|---|---|---|
| JP | 3-121661 | A | 12/1991 |
| JP | 2006-228759 | A | 8/2006 |
| JP | 2007-257905 | A | 10/2007 |
| JP | 2010-103012 | A | 5/2010 |
| JP | 2010-140807 | A | 6/2010 |
| WO | 2008/120632 | A1 | 10/2008 |
| WO | 2009/096591 | A1 | 8/2009 |
| WO | 2009/128344 | A1 | 10/2009 |
| WO | 2010/117019 | A1 | 10/2010 |

OTHER PUBLICATIONS

Written Opinion for PCT/JP2010/068881, dated Nov. 22, 2010 [PCT/ISA/237].

Search Report dated Feb. 21, 2013 issued by the European Patent Office in corresponding European Patent Application No. 10826680.0.

Office Action dated Aug. 21, 2013, issued by the Japanese Patent Office in counterpart Japanese Application No. 2009-247863.

Communication, dated Feb. 8, 2014, issued by the State Intellectual Property Office of P.R. China in counterpart Chinese Patent Application No. 201080048801.5.

Communication from the Japanese Patent Office dated Dec. 27, 2013, in a counterpart Japanese application No. 2009-247863.

Office Action dated Sep. 3, 2014 issued by the State Intellectual Property Office of the People's Republic of China in counterpart Chinese Patent Application No. 201080048801.5.

Office Action dated Dec. 3, 2014 issued by the State Patent Office of the People's Republic of China in counterpart Chinese Patent Application No. 201080048801.5.

* cited by examiner

PRESS BOND TERMINAL

TECHNICAL FIELD

The present invention relates to a press bond terminal of an open barrel type having a conductor press bond part with substantially a U-shaped cross section used in, for example, an electrical equipment system of an automobile.

BACKGROUND ART

FIG. 3 is a perspective view showing a configuration of a conventional press bond terminal described in, for example, U.S. Publication No, 2012/0006596, hereinafter Patent Reference 1.

This press bond terminal 100 includes an electrical connection part 101 connected to a terminal of the other connector side (not shown) in the front of a longitudinal direction (also a longitudinal direction of a conductor of an electric wire connected) of the terminal, and includes a conductor press bond part 110 crimped to the conductor in which the distal end of the electric wire (not shown) is exposed in the back of the electrical connection part 101, and further includes a coating crimp part 120 crimped to the portion having an insulating coating in the electric wire in the back of the conductor press bond part 110. Also, a first joining part 105 for joining the electrical connection part 101 to the conductor press bond part 110 is included between the electrical connection part 101 and the conductor press bond part 110, and a second joining part 106 for joining the conductor press bond part 110 to the coating crimp part 120 is included between the conductor press bond part 110 and the coating crimp part 120.

The conductor press bond part 110 is formed in substantially a U-shaped cross section by a base plate 111 and a pair of conductor crimp pieces 112, 112 which is extended upward from both right and left lateral edges of the base plate 111 and is crimped so as to wrap the conductor of the electric wire disposed on an inner surface of the base plate 111. Also, the coating crimp part 120 is formed in substantially a U-shaped cross section by a base plate 121 and a pair of coating crimp pieces 122, 122 which is extended upward from both right and left lateral edges of the base plate 121 and is crimped so as to wrap the electric wire (that is, the portion having the insulating coating) disposed on an inner surface of the base plate 121.

Also, both of the first joining part 105 and the second joining part 106 in the front and back of the conductor press bond part 110 are formed in substantially U-shaped cross sections by base plates 105A, 106A and low side plates 1058, 1068 upward erected from both right and left lateral edges of the base plates 105A, 106A.

Then, the portion ranging from a base plate (not shown) of the front electrical connection part 101 to the base plate of the backmost coating crimp part 120 (that is, the base plate 105A of the first joining part 105, the base plate 111 of the conductor press bond part 110, the base plate 106A of the second joining part 106 and the base plate 121 of the coating crimp part 120) is formed continuously in a shape of one band plate. Also, the front and back ends of the low side plate 105B of the first joining part 105 respectively continue with the back end of a side plate (numeral is omitted) of the electrical connection part 101 and each lower half part of the front end of the conductor crimp piece 112 of the conductor press bond part 110, and the front and back ends of the low side plate 106B of the second joining part 106 respectively continue with the back end of the conductor crimp piece 112 of the conductor press bond part 110 and each lower half part of the front end of the coating crimp piece 122 of the coating crimp part 120.

Also, an inner surface of the conductor press bond part 110 is provided with plural serrations 118 with a recessed groove shape extending in a direction orthogonal to the longitudinal direction (that is, the longitudinal direction of the terminal) of the conductor of the electric wire.

In the case of pressing and bonding the conductor press bond part 110 of this press bond terminal 100 to the conductor of the distal end of the electric wire, the press bond terminal 100 is placed on a placement surface (that is, an upper surface) of a lower mold (that is, an anvil) (not shown) and also, the conductor of the distal end of the electric wire is inserted between the conductor crimp pieces 112 of the conductor press bond part 110 and is placed on an upper surface of the base plate 111. Then, by downward moving an upper mold (that is, a crimper) relatively with respect to the lower mold, the distal end sides of the conductor crimp pieces 112 are gradually laid inward by a guide inclined surface of the upper mold.

Then, by further downward moving the upper mold (the crimper) relatively with respect to the lower mold, finally, the distal ends of the conductor crimp pieces 112 are rounded so as to be folded back to the conductor side by a curved surface ranging from the guide inclined surface of the upper mold to a chevron-shaped part of the center, and the distal ends of the conductor crimp pieces 112 are mutually bitten into the conductor while being rubbed together and thereby, the conductor crimp pieces 112 are crimped so as to wrap the conductor.

By the above operation, the conductor press bond part 110 of the press bond terminal 100 can be connected to the conductor of the electric wire by press bonding. In addition, similarly in the coating crimp part 120, using the lower mold and the upper mold, the coating crimp pieces 122 are gradually bent inward and are crimped to the portion having the insulating coating in the electric wire. This allows the press bond terminal 100 to be electrically and mechanically connected to the electric wire.

PRIOR ART REFERENCE

Patent Reference

Patent Reference 1: JP-A-2006-228759 (FIG. 1)

DISCLOSURE OF THE INVENTION

Problems that the Invention is to Solve

Incidentally, in the case of the conventional press bond terminal described above, a springback occurs due to a repulsive force of the conductor crimp pieces or the electric wire after press bonding, and the conductor crimp pieces crimped become open slightly and performance of electrical connection between the electric wire and the terminal may decrease. On the other hand, when the conductor crimp pieces are strongly crimped in order to prevent the springback, excessive press bonding may damage a core wire (that is, a conductor) to decrease the strength of fastening between the electric wire and the terminal in turn. Therefore, it is difficult to ensure compatibility between electrical connection performance and mechanical connection performance in the case of connecting the terminal to the electric wire.

In view of the circumstances described above, an object of the invention is to provide a press bond terminal capable of easily ensuring compatibility between electrical connection performance and mechanical connection performance in the case of connecting a terminal to an electric wire by reducing a springback of a conductor crimp piece.

Means for Solving the Problems (1) In order to solve the problem described above, one aspect of the invention provides a press bond terminal in which the front of a longitudinal direction of a terminal is provided with an electrical connection part and the back of the electrical connection part is provided with a conductor press bond part connected by being pressed and bonded to a conductor of a distal end of an electric wire through a first joining part and the back of the conductor press bond part is further provided with a coating crimp part through a second joining part, and the conductor press bond part is formed in substantially a U-shaped cross section by a base plate and a pair of conductor crimp pieces which is extended upward from both right and left lateral edges of the base plate and is crimped so as to wrap the conductor disposed on an inner surface of the base plate, and both of the first joining part and the second joining part are formed in substantially U-shaped cross sections by base plates and low side plates upward erected from both right and left lateral edges of the base plates, and the base plate of the conductor press bond part is formed continuously with the base plates of the first and second joining parts and lower half parts of the conductor crimp pieces of the conductor press bond part are formed continuously with the low side plates of the first and second joining parts, wherein any place ranging from an inner surface of the conductor crimp piece to an inner surface of the side plate of the joining part is provided with a projection.

(2) In the press bond terminal of (1) described above, a region of making close contact with a conductor of an electric wire at the time of press bonding in the inner surface of the conductor crimp piece is preferably provided with the plural projections spaced in front and back directions.

(3) In the press bond terminal of (1) described above, the inner surfaces of each of the side plates of the first joining part and the second joining part are preferably respectively provided with the projections.

Advantage of the Invention

According to the press bond terminal of (1) described above, any place ranging from the inner surface of the conductor crimp piece of the conductor press bond part to the inner surface of the side plate of the joining part is provided with the projection, so that a rib effect by the projection or work hardening by forming the projection can increase rigidity of a place of the formed projection and its periphery. Therefore, when the inner surface of the conductor crimp piece is provided with the projection, an increase in rigidity of the conductor crimp piece by the presence itself of the projection can reduce a springback after press bonding of the conductor crimp pieces. Also, when the inner surface of the side plate of the joining part is provided with the projection even though the inner surface of the conductor crimp piece is not provided with the projection, an increase in rigidity of the side plate of the joining part continuous with the conductor crimp piece can reduce the springback after press bonding of the conductor crimp pieces. As a result, a press bond shape of the conductor press bond part can surely be maintained and also a grip force of the conductor press bond part on the conductor of the electric wire can be improved and thereby, misalignment between core wires of the conductor can be reduced and the range of compatibility between stable electrical contact and fastening strength can be expanded.

When the region of making close contact with the conductor of the electric wire at the time of press bonding in the inner surface of the conductor crimp piece is provided with the plural projections spaced in the front and back directions as shown in the press bond terminal of (2) described above, the presence of the projections projecting to the side of the conductor of the electric wire in the conductor press bond part can increase internal stress of the conductor press bond part as compared with a press bond part with the same crimp height (C/H) having no projections. Also, in conjunction with an increase in the internal stress, an increase in a binding force of the conductor in a region sandwiched between the front and back projections strengthens action of reducing misalignment between core wires of the conductor, and a more stable electrical contact state can be maintained.

When the inner surfaces of each of the side plates of the first joining part and the second joining part are respectively provided with the projections as shown in the press bond terminal of (3) described above, the presence of the projections in the inner surfaces of the side plates of the joining parts increases rigidity of the joining parts and accordingly, a springback of the conductor crimp pieces is reduced. This can substantially increase rigidity of the conductor crimp pieces even though the conductor crimp pieces have no projection, and a more stable electrical contact state can be maintained.

MODE FOR CARRYING OUT THE INVENTION

Embodiments of the invention will hereinafter be described using the drawings.

In addition, in a press bond terminal of the invention, the side connected to the other connector is set at the front and the side connected to an electric wire is set at the back.

First Embodiment

Figure 1A:
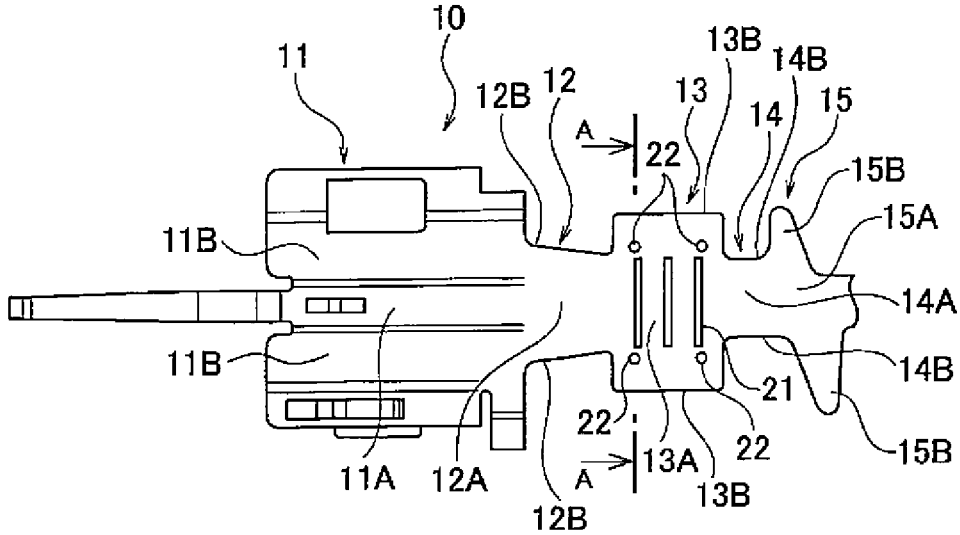
FIGS. 1(*a*) to 1(*c*) are configuration views of a press bond terminal of a first embodiment of the invention, and FIG. 1(*a*) is a developed plan view of the press bond terminal, and FIG. 1(*b*) is a sectional view taken on arrow line A-A of FIG. 1(*a*), and FIG. 1(*c*) is a transverse sectional view showing a state after a conductor press bond part of the press bond terminal is pressed and bonded.
Figure 1B:
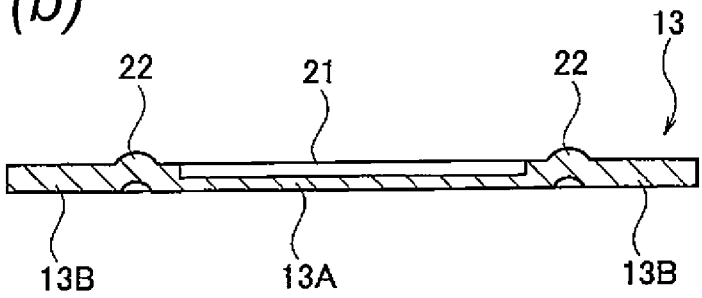
Figure 1C:
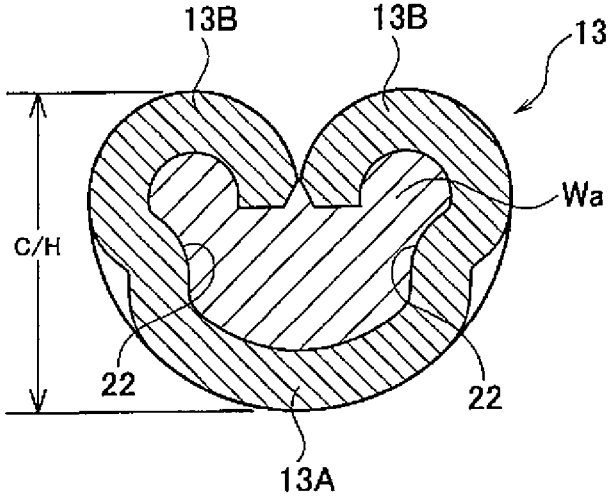
Figure 2A:
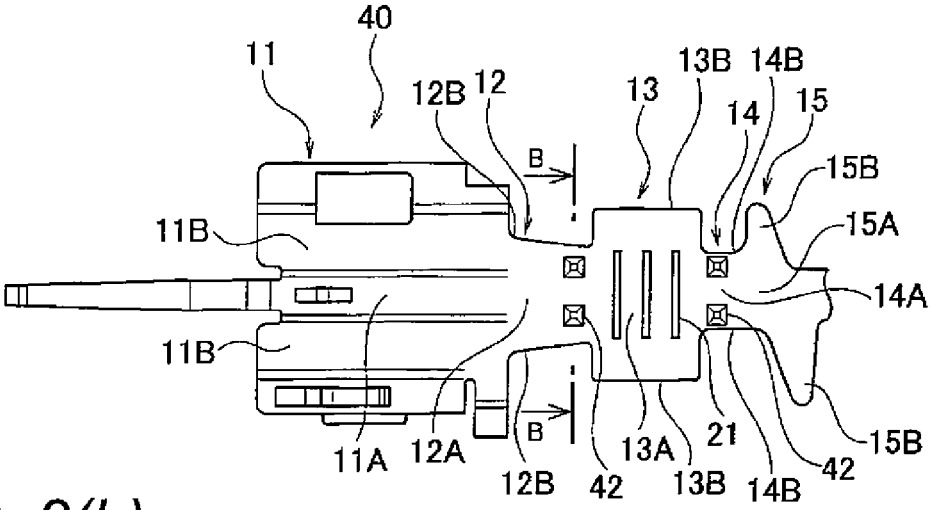
FIGS. 2(*a*) to 2(*d*) are configuration views of a press bond terminal of a second embodiment of the invention, and FIG. 2(*a*) is a developed plan view of the press bond terminal, and FIG. 2(*b*) is a sectional view taken on arrow line B-B of FIG. 2(*a*), and FIG. 2(*c*) is a partially perspective view showing a state after the conductor press bond part of the press bond terminal is pressed and bonded, and FIG. 2(*d*) is a sectional view taken on arrow line C-C of FIG. 2(*c*).
Figure 2B:
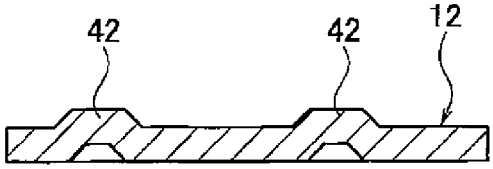
Figure 2C:
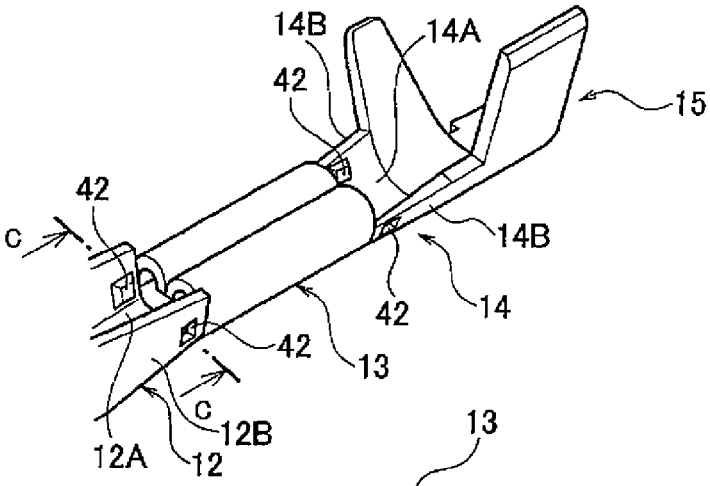
Figure 2D:
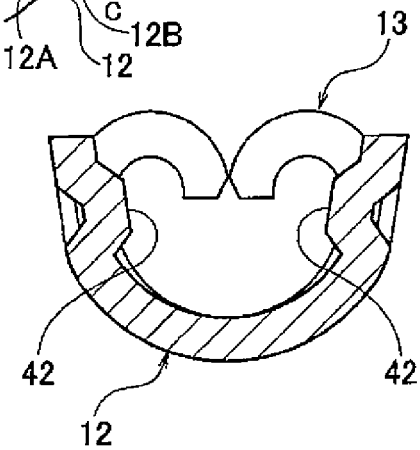
Figure 3:
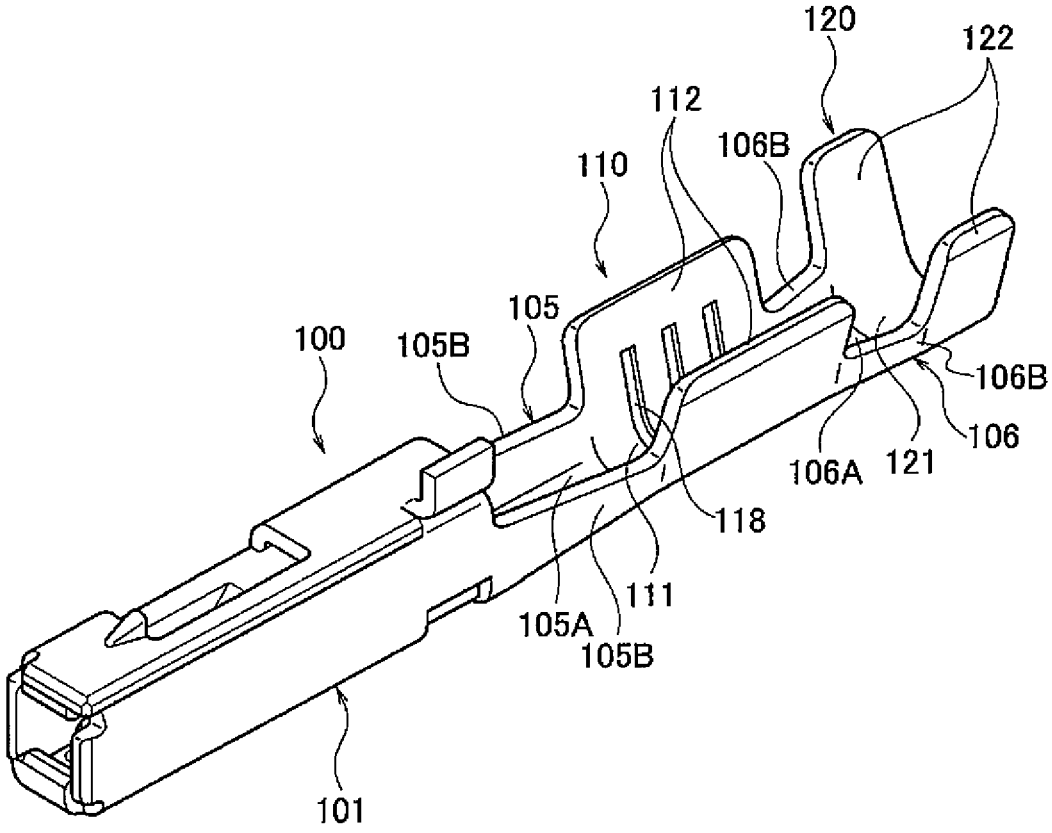
FIG. 3 Prior Art
FIG. 3 is a perspective view showing a configuration of a conventional press bond terminal.

FIGS. 1(*a*) to 1(*c*) are configuration views of a press bond terminal of a first embodiment, and FIG. 1(*a*) is a developed plan view of the press bond terminal, and FIG. 1(*b*) is a sectional view taken on arrow line A-A of FIG. 1(*a*), and FIG. 1(*c*) is a transverse sectional view showing a state after a conductor press bond part of the press bond terminal is pressed and bonded.

This press bond terminal 10 includes an electrical connection part 11 connected to a terminal of the other connector side in the front of a longitudinal direction (also a longitudinal direction of a conductor of an electric wire connected) of the terminal, and includes a conductor press bond part 13 crimped to the conductor in which the distal end of the electric wire (not shown) is exposed in the back of the electrical connection part 11, and further includes a coating crimp part 15 crimped to the portion having an insulating coating in the electric wire in the back of the conductor press bond part 13. Also, a first joining part 12 for joining the electrical connection part 11 to the conductor press bond part 13 is included between the electrical connection part 11 and the conductor press bond part 13, and a second joining part 14 for joining the conductor press bond part 13 to the coating crimp part 15 is included between the conductor press bond part 13 and the coating crimp part 15.

The conductor press bond part 13 is formed in substantially a U-shaped cross section by a base plate 13A and a pair of conductor crimp pieces 13B, 13B which is extended upward from both right and left lateral edges of the base plate 13A and is crimped so as to wrap the conductor of the electric wire disposed on an inner surface of the base plate 13A.

Also, the coating crimp part 15 is formed in substantially a U-shaped cross section by a base plate 15A and a pair of coating crimp pieces 15B, 15B which is extended upward from both right and left lateral edges of the base plate 15A and is crimped so as to wrap the electric wire (the portion having the insulating coating) disposed on an inner surface of the base plate 15A.

Also, both of the first joining part 12 and the second joining part 14 in the front and back of the conductor press bond part 13 are formed in substantially U-shaped cross sections by base plates 12A, 14A and low side plates 12B, 14B upward erected from both right and left lateral edges of the base plates 12A, 14A.

Then, the base plates ranging from the front electrical connection part 11 to the backmost coating crimp part 15, that is, a base plate 11A of the electrical connection part 11, the base plate 12A of the first joining part 12, the base plate 13A of the conductor press bond part 13, the base plate 14A of the second joining part 14 and the base plate 15A of the coating crimp part 15 are formed continuously in a shape of one band plate. Also, the front and back ends of the low side plate 12B of the first joining part 12 respectively continue with the back end of a side plate 11B of the electrical connection part 11 and each lower half part of the front end of the conductor crimp piece 13B of the conductor press bond part 13, and the front and back ends of the low side plate 14B of the second joining part 14 respectively continue with the back end of the conductor crimp piece 13B of the conductor press bond part 13 and each lower half part of the front end of the coating crimp piece 15B of the coating crimp part 15.

Also, an inner surface of the conductor press bond part 13 is provided with plural serrations 21 with a recessed groove shape extending in a direction orthogonal to the longitudinal direction (the longitudinal direction of the terminal) of the conductor of the electric wire.

Also, in this press bond terminal 10, inner surfaces of a pair of conductor crimp pieces 13B, 13B of the conductor press bond part 13 are provided with plural projections 22 formed by being pushed from an outer surface. In these projections 22, plural projections spaced in the front and back directions are formed in a region of making close contact with a conductor Wa of an electric wire at the time of press bonding in the inner surfaces of the conductor crimp pieces 13B.

In the case of pressing and bonding the conductor press bond part 13 of this press bond terminal 10 to the conductor Wa of the distal end of the electric wire, the press bond terminal 10 is placed on a placement surface (an upper surface) of a lower mold (an anvil) (not shown) and also, the conductor of the distal end of the electric wire is inserted between a pair of conductor crimp pieces 13B, 13B of the conductor press bond part 13 and is placed on an upper surface of the base plate 13A. Then, by downward moving an upper mold (a crimper) relatively with respect to the lower mold, the distal end sides of the conductor crimp pieces 13B are gradually laid inward by a guide inclined surface of the upper mold. Then, by further downward moving the upper mold (the crimper) relatively with respect to the lower mold, finally, as shown in FIG. 1(*c*), the distal ends of the conductor crimp pieces 13B are rounded so as to be folded back to the side of the conductor Wa by a curved surface ranging from the guide inclined surface of the upper mold to a chevron-shaped part of the center, and the distal ends of the conductor crimp pieces 13B are mutually bitten into the conductor Wa while being rubbed together and thereby, the conductor crimp pieces 13B are crimped so as to wrap the conductor Wa. By the above operation, the conductor press bond part 13 of the press bond terminal 10 can be connected to the conductor Wa of the electric wire by press bonding. Similarly in the coating crimp part 15, using the lower mold and the upper mold, the coating crimp pieces 15B are gradually bent inward and are crimped to the portion having the insulating coating in the electric wire. This allows the press bond terminal 10 to be electrically and mechanically connected to the electric wire.

The press bond terminal 10 of the embodiment can have the following effects in a state of making connection by press bonding thus.

First, the inner surfaces of the conductor crimp pieces 13B of the conductor press bond part 13 are provided with the projections 22, so that a rib effect by the projections 22 or work hardening by forming the projections 22 can increase rigidity of a place of the formed projections 22 and its periphery (mainly, the conductor crimp pieces 13B). Therefore, a springback after press bonding of the conductor crimp pieces 13B can be reduced, with the result that a press bond shape of the conductor press bond part 13 can surely be maintained and a grip force of the conductor press bond part 13 on the conductor of the electric wire can be improved and also, misalignment between core wires of the conductor Wa can be reduced and the range of compatibility between stable electrical contact and fastening strength can be expanded.

Also, the presence of the projections 22 projecting to the side of the conductor Wa of the electric wire in the conductor press bond part 13 can increase internal stress of the conductor press bond part 13 as compared with a press bond part with the same crimp height (C/H) having no projections 22. Also, in conjunction with an increase in the internal stress, an increase in a binding force of the conductor Wa in a region sandwiched between the front and back projections 22 strengthens action of reducing misalignment (particularly, misalignment in the front and back directions) between core wires of the conductor Wa, and a more stable electrical contact state can be maintained.

Second Embodiment

FIGS. 2(*a*) to 2(*d*) are configuration views of a press bond terminal of a second embodiment, and FIG. 2(*a*) is a developed plan view of the press bond terminal, and FIG. 2(*b*) is a sectional view taken on arrow line B-B of FIG. 2(*a*), and FIG. 2(*c*) is a partially perspective view showing a state after the conductor press bond part of the press bond terminal is pressed and bonded, and FIG. 2(*d*) is a sectional view taken on arrow line C-C of FIG. 2(*c*).

This press bond terminal 40 of the second embodiment differs from the press bond terminal 10 of the first embodiment in that an inner surface of a conductor crimp piece 13B of a conductor press bond part 13 is not provided with a projection and an inner surface of a side plate 12B of a first joining part 12 and an inner surface of a side plate 14B of a second joining part 14 are provided with projections 42. Since the others are similar to the first embodiment, explanation is omitted by assigning the same numerals to the same portions.

By providing the inner surfaces of the side plates 12B, 14B of the joining parts 12, 14 with the projections 42 thus, rigidity of the side plates 12B, 14B of the joining parts 12, 14 increases and accordingly, a springback of the continuous conductor crimp pieces 13B is reduced. This can substantially increase rigidity of the conductor crimp pieces 13B even though the conductor crimp pieces 13B have no projection. As a result, a press bond shape of the conductor press bond part 13 can surely be maintained and a grip force of the conductor press bond part 13 on a conductor of an electric wire can be improved and also, misalignment between core wires of the conductor can be reduced and the range of compatibility between stable electrical contact and fastening strength can be expanded.

In addition, the projections can be formed in any place in the range from the inner surfaces of the conductor crimp pieces 13B to the inner surfaces of the side plates 12B, 14B of the joining parts 12, 14.

The present application is based on Japanese patent application (patent application No. 2009-247863) filed on Oct. 28, 2009, and the contents of the patent application are hereby incorporated by reference.

DESCRIPTION OF REFERENCE NUMERALS AND SIGNS

10, 40 PRESS BOND TERMINAL
11 ELECTRICAL CONNECTION PART
12 FIRST JOINING PART
12A BASE PLATE
12B SIDE PLATE
13 CONDUCTOR PRESS BOND PART
13A BASE PLATE
13B CONDUCTOR CRIMP PIECE
14 SECOND JOINING PART
14A BASE PLATE
14B SIDE PLATE
15 COATING CRIMP PART
22 PROJECTION
42 PROJECTION

The invention claimed is:

1. A press bond terminal in which a front in a longitudinal direction of a terminal is provided with an electrical connection part and the back of the electrical connection part is provided with a conductor press bond part connected by being pressed and bonded to a conductor of a distal end of an electric wire through a first joining part and the back of the conductor press bond part is further provided with a coating crimp part through a second joining part, and the conductor press bond part is formed in substantially a U-shaped cross section by a base plate and a pair of conductor crimp pieces which is extended upward from both right and left lateral edges of the base plate and is crimped so as to wrap the conductor disposed on an inner surface of the base plate, and both of the first joining part and the second joining part are formed in substantially U-shaped cross sections by base plates and low side plates upward erected from both right and left lateral edges of the base plates, and the base plate of the conductor press bond part is formed continuously with the base plates of the first and second joining parts and lower half parts of the conductor crimp pieces of the conductor press bond part are formed continuously with the low side plates of the first and second joining parts, wherein any place ranging from an inner surface of at least one of the first joining part and the second joining part is provided with at least one projection, and wherein the at least one projection is configured to engage a side of the conductor, wherein the at least one projection is provided on only at least one of the first joining part and the second joining part.

2. The press bond terminal according to claim 1, wherein a region of making close contact with a conductor of an electric wire at the time of press bonding in the inner surface of the conductor crimp piece is preferably provided with a plurality of the at least one projection spaced in front and back directions.

3. The press bond terminal according to claim 1, wherein the inner surfaces of each of the side plates of the first joining part and the second joining part are preferably respectively provided with a plurality of the at least one projection.

4. A press bond terminal in which a front in a longitudinal direction of a terminal is provided with an electrical connection part and the back of the electrical connection part is provided with a conductor press bond part connected by being pressed and bonded to a conductor of a distal end of an electric wire through a first joining part and the back of the conductor press bond part is further provided with a coating crimp part through a second joining part, and the conductor press bond part is formed in substantially a U-shaped cross section by a base plate and a pair of conductor crimp pieces which is extended upward from both right and left lateral edges of the base plate and is crimped so as to wrap the conductor disposed on an inner surface of the base plate, and both of the first joining part and the second joining part are formed in substantially U-shaped cross sections by base plates and low side plates upward erected from both right and left lateral edges of the base plates, and the base plate of the conductor press bond part is formed continuously with the base plates of the first and second joining parts and lower half parts of the conductor crimp pieces of the conductor press bond part are formed continuously with the low side plates of the first and second joining parts, wherein any place ranging from an inner surface of the conductor crimp piece to an inner surface of the side plate of the joining part is provided with at least one projection, and wherein the at least one projection is configured to engage a side of the conductor, wherein the conductor press bond part is provided with at least one plural serration.

* * * * *